United States Patent [19]

King

[11] 3,991,397

[45] Nov. 9, 1976

[54] IGNITION CABLE

[75] Inventor: Gregory C. King, Columbus, Ohio

[73] Assignee: Owens-Corning Fiberglas Corporation, Toledo, Ohio

[22] Filed: July 7, 1975

[21] Appl. No.: 593,418

Related U.S. Application Data

[63] Continuation of Ser. No. 440,218, Feb. 6, 1974, abandoned.

[52] U.S. Cl. ..... 338/214; 174/102 SC; 174/120 SC; 252/511

[51] Int. Cl.[2] ..... H01C 3/06

[58] Field of Search ..... 338/214; 174/102 SC, 174/120 SC, 110 F; 252/511

[56] References Cited

UNITED STATES PATENTS

| | | | |
|---|---|---|---|
| 2,526,059 | 10/1950 | Zabez | 252/511 |
| 3,684,755 | 8/1972 | Gumerman | 174/110 FC |
| 3,697,450 | 10/1972 | Takewaka | 252/511 |
| 3,818,412 | 6/1974 | Deardurff | 338/214 |
| 3,870,987 | 3/1975 | Wiley et al. | 338/214 |

*Primary Examiner*—E. A. Goldberg

*Attorney, Agent, or Firm*—John W. Overman; Philip R. Cloutier

[57] ABSTRACT

The disclosed conductor includes a core, having a plurality of conductive glass fibers, an overwrap of non-conductive glass strands wound under tension around the core and a semi-conductive overcoat, preferably of polytetrafluoroethylene having suspended therein conductive powders, and silica. The overwrap includes distinct windings, rather than a braid, which securely retains the fibers in a cylindrical core of uniform cross-section.

9 Claims, 3 Drawing Figures

IGNITION CABLE

This application is a continuation of Ser. No. 440,218 filed Feb. 6, 1974 now abandoned.

FIELD OF THE INVENTION

The conductor of this invention is particularly suitable for high temperature applications which require uniform conductance, such as spark ignition cables used in automobiles. The preferred conductor combines the advantages of conductive glass fibers with the high temperature service capabilities of an improved semi-conductive Teflon overcoat.

The problems of electrical interference with communications, including radio and television has for example, resulted in certain government standards applicable to automotive ignition cables. Also, the temperature underneath an automobile hood has increased steadily, due to larger horsepower engines and emission control devices, requiring greater temperature service capabilities for all engine components, including ignition cables. These requirements have created an urgent need for ignition cables having high temperature service capabilities and a uniform conductance, which are met by the conductors prepared by the methods of this invention. Further, the electrical conductors of this invention are particularly suitable for other applications, including heating elements for domestic appliances and for extreme service applications, such as driveway and gutter heating elements which are subjected to weather, impact and wear.

When, as in the past, a Teflon-graphite dispersion was used as the overcoat composition for overwrapped, conductive glass fibers, there were some problems associated therewith, including non-uniformity and roughness of the coating and low modulus of the coating.

However, when an electrical conductor is produced according to the concepts of this invention, the above problems are overcome. That is, a smooth uniform coating is produced and the modulus of the coating is increased without affecting the conductance of the overcoat.

It has been found that a smooth, uniform, high modulus overcoat is necessary for subsequent processing of the electrical conductor. Subsequent processing operations include extruding a primary insulation material over the electrical conductor of this invention, removing sufficient primary insulation material from the ends of the conductor and applying terminals to the ends of the electrical conductor.

In the past, the overcoat for the glass fiber conductive core tended to be rough and non-uniform, and upon extruding the primary insulation material thereover, thin and thick areas occurred along the length of the conductive core. When a potential was applied and increased, dielectric breakdown occurred at the thin areas of the insulation material.

Additionally, in the past, the glass fiber conductors, overcoated with a dispersion of polytetrafluoroethylene and graphite, lacked sufficient modulus to be efficiently used on machinery designed for metallic conductors.

Further, in the past, the primary insulation could not be consistently removed without exposing the conductive core, i.e. some of the overcoat was peeled off, thereby causing a short.

Another problem, in the past, when a Teflon-graphite dispersion was used as the overcoat composition for overwrapped, conductive glass fibers, was a lack of controlled adhesion between the overcoat and the primary insulating material. Upon stripping the primary insulation from the electrical conductor, stress had to be applied to the conductor because of the lack of controlled adhesion between the overcoat and the primary insulating material. The stress applied during stripping tended to separate, at the points of stress, the overcoated conductor from the primary insulator. This separation, upon use of the conductor, caused a condition known as corona breakdown. Corona breakdown is defined as an electrical energy build up in a localized area, such as between the conductor and the primary insulation material. This electrical energy build up is subsequently converted to heat energy, which leads to the breakdown of the core, i.e. high resistance shorting occurs. The breakdown, which is caused by the heat build up, is apparently due to the oxidation of graphite and polytetrafluoroethylene.

The above problems are overcome by the practice of this invention, wherein the improved overcoat composition provides a smooth, uniform coating, having sufficient modulus to be used in existing machinery designed for metallic conductors, and further provides controlled adhesion between the electrical conductor and the primary insulation material.

The conductance of polymer systems is theorized to be due to chains of conductive particles that create pathways for current flow through an essentially insulating polymer. This phenonomen is known in the art, but in order for these systems to achieve high levels of conductance, it is necessary to use high percentages of conductive particles.

When conductance is achieved through the concepts of this invention, the amount of conductive particles can be substantially lowered and still achieve equivalent conductance. This is theorized to be attributed to the use of an amorphous filler, which increases the probability that electrical pathways will be created. It is further theorized that the conductive particles coat the surfaces of the amorphous filler, and when the coated filler is introduced into the polymer system there is an increased density as compared to the use of conductive particles, only, which increases the likelihood of a touching relationship between the conductive particles. That is, the amorphous filler helps control the conductivity of the overcoat composition.

The improved electrical conductor of this invention includes a conductive core, means to retain the elements of the core in uniform circular cross-section and means for insuring uniform conductance between the core and a semi-conductive overcoat. In the preferred embodiment, the core includes a plurality of conductive fibers, such as the conductive fibers disclosed in U.S. Pat. Nos. 3,247,020 and 3,269,883 which are assigned to the assignee of the instant application. The fibers are securely retained in a cylindrical bundle by winding non-conductive strands, under tension around the core fibers. The strand windings are preferably distinct, rather than laced and are uniformily spaced to provide a matrix of spaces which assures uniform conductance between the core and the semi-conductive overcoat. The semi-conductive overcoat comprises as essential ingredients, polytetrafluoroethylene, because of its high temperature service capabilities and wear resistance, conductive particles, preferably graphite or carbon, and an amorphous filler such as silica.

The overwrap may comprise distinct winding layers or a single spiral winding rather than a braid, both of which provide uniform spacing. The spacing of the overwrap is preferably controlled to between one-sixteenth and three-sixteenth inches to insure that the conductive glass fibers, constituting the core, are under uniform compression or tension, and have uniform cross-section.

The polytetrafluoroethylene containing overcoat of this invention makes it easier to strip the insulation from the electrical conductor than conventional synthetic rubber overcoats or prior known polytetrafluoroethylene overcoats. Graphite or carbon particles are preferred because the particles are substantially uniform in size are commercially available at a lesser expense than other conductive particles. The amorphous filler, is preferably silica, having a low crystalline structure so that the physical properties of the glass fibers are not affected, such as by abrasion.

Other advantages and meritorious features of the disclosed conductor will be more fully understood from the following description of the preferred embodiments, the attached drawings and the claims.

DESCRIPTION OF THE PREFERRED EMBODIMENT

Figure 1:
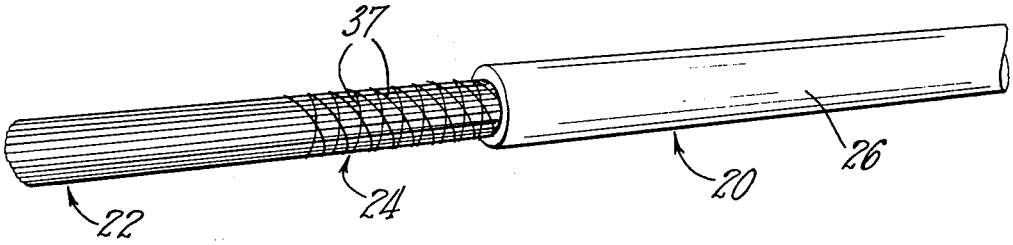
FIG. 1 is a perspective view, with cut away portions, showing one embodiment of the electrical conductor of this invention.
Figure 3:
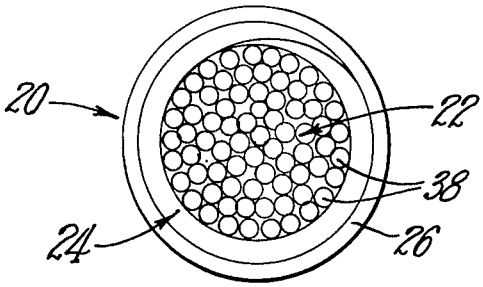
FIG. 3 is an end view of the electrical conductor shown in FIG. 1.

The electrical conductor 20 shown in FIGS. 1 and 3 includes a conductive core 22, a non-conductive overwrap 24 and a semi-conductive overcoat 26. In the preferred embodiment, the core is composed of a plurality of elongated conductive fibers 38, as shown in FIG. 3. The conductive fibers may be formed from strands of glass by the method described in U.S. Pat. Nos. 3,247,020 and 3,269,883, which are assigned to the assignee of the instant application.

Figure 2:
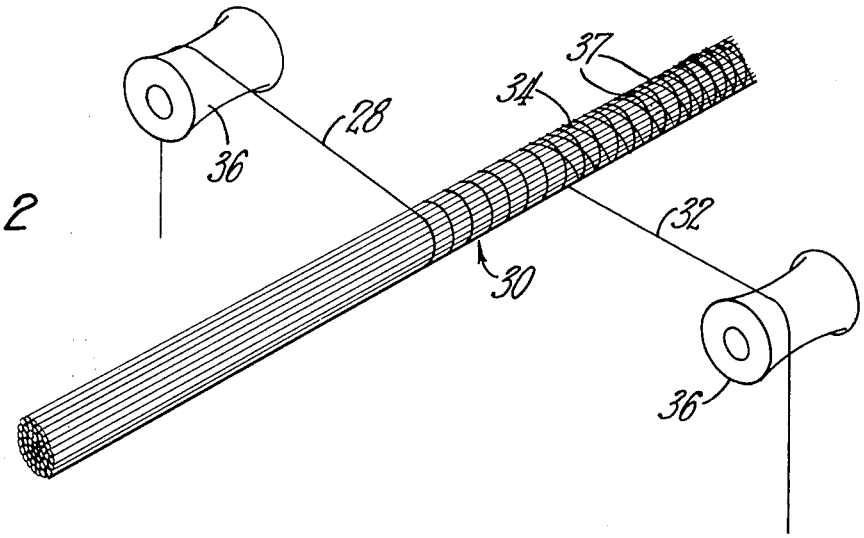
FIG. 2 is a perspective, partially schematic view of the conductive core and the method of winding the overwrap in the manufacture of the electrical conductor shown in FIG. 1.

The overwrap 24 comprises windings of non-conductive strands, such as the glass strands disclosed in U.S. Pat. No. 2,333,961 and sold by the assignee of the instant application As "E=Glass". The strands are preferably wound under uniform tension in distinct layers, rather than braided as shown in FIG. 2. The core can be overwrapped with only one strand to form a spiral wrap, but the embodiment of FIG. 2 shows a two strand overwarp. The first strand 28 is wound around the core under tension to form a first layer 30 and the second strand 32 is wound under tension over the first layer to form a second layer 34, generally perpendicular to the first layer. The winding method shown in FIG. 2 includes two spindles 36 which applies tension to the strands 28 and 32 during winding.

The strands are preferably wound under tension to accurately control the circular cross-section of the fiber bundle 22, which is particularly important in subsequent processing operations as described hereinbelow. As will be noted from FIGS. 1 and 2, the strand windings are uniformly spaced on the core 22 to provide a uniform matrix of non-insulating or conductive spacings or diamond-shaped openings 37. In the preferred embodiment, the strands are uniformly spaced a distance of one-sixteenth to three-sixteenth inches. In practice, a strand having twist has been used to provide an overwrap that promotes roundness of the bundle 22. Glass strands having between 1 and 4 turns per inch (TPI) have given good results.

As described above, the winding of the overwrap under uniform tension, is particularly important to the conductor of this invention to maintain the glass fiber core in a cylindrical bundle having a uniform cross-section. The uniform cross-section of the bundle assures that a more uniform coating or wall thickness of insulation (not shown in the drawings) is extruded about the conductive core. And as mentioned, use of strands having twist has been used to promote a more uniform circular cross-section of the bundle 22 along its length. The uniform spacing of the strands, as described above, in combination with the semi-conductive overcoat and the uniform thickness of the overcoat also assures uniform conductance.

The overcoat 26 is a uniform layer of semi-conductive material, which serves as a processing aid in subsequent operations by fabricators. In the preferred embodiment, the overcoat is a high temperature and friction resistant material having fine particles of a conductive powder and an amorphous filler suspended therein. The preferred high temperature material for the overcoat is a semi-conductive polytetrafluoroethylene, which polytetrafluoroethylene provides the medium for suspending conductive particles therein, makes it easier to strip insulation from the conductor than conventional synthetic rubber products, has excellent high temperature service capabilites, and protects the core during processing because of its low coefficient of friction.

The preferred conductive material is a graphite or carbon particulate, although other conductive materials may also be utilized. Graphite is relatively inexpensive and commercially available in uniform size ranges. The preferred graphite powder has a size range comprising about 10 percent of one to three micron particles and 90 percent of less than one micron particles.

When the conductor of this invention is insulated, (not shown in the drawings), it may then be utilized as an ignition cable. The conductor may be insulated by extruding a primary insulation, such as silicone rubber, over the overcoat, retaining the primary insulation with fibrous glass braid and forming an outer jacket over the braid with suitable material, such as silicone rubber, Following are examples of overcoat compositions of this invention which utilize polytetrafluoroethylene, conductive particles, and amorphous filler as essential ingredients. In addition thereto, gel agents, surfactants, anti-foams, and pH adjustors may be added to the compositions.

EXAMPLE I

| Ingredients | Percent by Weight (Solids) |
|---|---|
| Polytetrafluoroethylene | 10 – 60 |
| Conductive particles | 2 – 55 |
| Amorphous filler | 1 – 55 |
| Water | Balance, to a solids of about 4–80% |

EXAMPLE II

| Ingredients | Percent by Weight (Solids) |
|---|---|
| Polytetrafluoroethylene | 43.5 |
| Conductive particles | 47.0 |
| Amorphous filler | 9.5 |
| Water | Balance, to a solids of about 4–80% |

EXAMPLE III

| Ingredients | Percent by Weight (Solids) |
|---|---|
| Polytetrafluoroethylene | 58.5 |
| Conductive particles | 5.5 |
| Amorphous filler | 36.0 |
| Water | Balance, to a solids of about 4–80% |

EXAMPLE IV

| Ingredients | Percent by Weight (Solids) |
|---|---|
| Polytetrafluoroethylene | 15.0 |
| Graphite particles | 3.0 |

EXAMPLE IV-continued

| Ingredients | Percent by Weight (Solids) |
|---|---|
| Silica | 10.0 |
| Water | Balance, to a solids of about 4–80% |

A preferred mixing procedure for the compositions of Examples I, II, III and IV comprises adding water to a mix tank at room temperature and adding thereto the amorphous filler, with agitation, until a paste is formed and is free flowing and free of lumps. Under strong agitation, the conductive particles are added to the mix until the mix is free flowing and without the presence of lumps. Under reduced agitation, sufficient to insure that the mix is free flowing, the polytetrafluoroethylene is gradually added, which addition will lower the viscosity of the mix to about 15 – 4000 cps. The order of addition of the ingredients has been found to have a significant effect on the conductive properties of the compositions. That is, if the order of addition is not followed as stated hereinabove, the conductive properties of the compositions are adversely affected.

EXAMPLE V

| Ingredients | Percent by Weight (Solids) |
|---|---|
| Polytetrafluoroethylene | 10 – 60 |
| Conductive particles | 2 – 55 |
| Thixotrope | 0.01 – 1.0 |
| Amorphous Filler | 1 – 55 |
| Surfactant | 0.01 – 7.0 |
| Soluble or emulsifiable anti-foam agent | 0.01 – 1.0 |
| Insoluble anti-foam agent | 0.001 – 0.01 |
| pH adjustor, to a pH of about 10 or above | as required |
| Water | Balance, to a solids of about 4–80% |

EXAMPLE VI

| Ingredients | Percent by Weight (Solids) |
|---|---|
| Polytetrafluoroethylene | 45.79 |
| Graphite particles | 12.50 |
| Thixotrope | 0.05 |
| Silica | 10.07 |
| Surfactant | 3.02 |
| Soluble or emulsifiable anti-foam agent | 0.50 |
| Insoluble anti-foam agent | 0.005 |
| pH adjustor, to a pH of about 10 or above | as required |
| Water | Balance, to a solids of about 4–80% |

EXAMPLE VII

| Ingredients | Percent by Weight (Solids) |
|---|---|
| Polytetrafluoroethylene | 55.0 |
| Carbon particles | 25.0 |
| Thixotrope | 0.05 |
| Silica | 8.0 |
| Surfactant | 3.02 |
| Soluble or emulsifiable anti-foam agent | 0.50 |
| pH adjustor, to a pH of about 10 or above | as required |
| Water | Balance, to a solids of about 4–80% |

EXAMPLE VIII

| Ingredients | Percent by Weight (Solids) |
|---|---|
| Polytetrafluoroethylene | 15.0 |
| Graphite particles | 3.0 |
| Thixotrope | 0.05 |
| Silica | 10.0 |
| Surfactant | 3.02 |
| Soluble or emulsifiable anti-foam agent | 0.50 |

EXAMPLE VIII-continued

| Ingredients | Percent by Weight (Solids) |
|---|---|
| Water | Balance, to a solids of about 4–80% |

When an insoluble anti-foam agent is not included in the overcoat composition, it may be coated on the mixing vessel to help prevent foaming.

A preferred mixing procedure for the compositions of Examples V, VI, VII and VIII comprises adding water to a mix tank at room temperature and adding thereto, a thixotrope under strong agitation until the mix is homogenous. If necessary, the mix may be heated to about 180°F to facilitate mixing, but the mix must be thereafter cooled to less than 80°F prior to the adding of other ingredients. Under strong agitation, a filler, preferably silica, is added to the mix with agitation until a paste is formed and is free flowing and free of lumps. Under strong agitation, graphite is added to the mix until the mix is free flowing and without the presence of lumps. Thereafter, the pH of the mix is adjusted to about 10–11 with, for example, amonium hydroxide, and the surfactant and anti-foams are added to the mix with agitation. Under reduced agitation, sufficient to insure that the mix is free flowing, the polytetrafluoroethylene is gradually added. The addition of polytetrafluoroethylene will lower the viscosity of the mix to about 15 – 4000 cps. The order of addition of the ingredients has been found to have a significant effect on the conductive properties of the compositions. That is, by sequentially adding and mixing the ingredients as stated hereinabove, the conductive properties of the compositions are greater than the same compositions which do not follow the specific order of addition.

The above mixing procedures are preferred especially with respect to the addition of polytetrafluoroethylene, at the end of the mixing cycle. Polytetrafluoroethylene is extremely sheer — sensitive and is also sensitive to rapid changes in ionic concentrations. Since the ingredients in the above compositions are added with agitation, it is possible that the polytetrafluoroethylene might be adversely affected if added prior to the end of the mixing cycle, by the sheering action of the mixer during the addition of the other ingredients. It is possible for the pH adjustor, such as ammonium hydroxide, when it is used, to be added after the addition of polytetrafluoroethylene, but it should be done in small increments to prevent a rapid change in ionic concentration.

The preferred method of manufacturing the electrical conductor 20 of this invention then includes, bundling of a plurality of elongated conductive fibers 38 into a generally cylindrical core 22, as shown in FIG. 3. The number of fibers will depend upon the particular application for the conductor, however, a suitable core has about sixty conductive glass fiber strands e.g., C-150's strands, having about 204 glass fiber filaments, forming a cylindrical core having a diameter of about 0.050 inches. The method then includes winding, under tension distinct layers (30 and/or 34) of nonconductive strands 28 and/or 32, as shown in FIG. 2, to securely retain the fibers 38 of the core in a uniform circular cross-section. The strands 28 and/or 32 are preferably uniformly spaced and angularly wound on the core to provide a matrix of uniformly spaced or diamond shaped non-insulating apertures 37, uniformly spaced axially and longitudinally on the core to assure that a uniform coating of insulation is extruded about the conductive core.

Finally, the core and overwrap are encased in a semi-conductive overcoat 26, preferably comprising polytetrafluoroethylene, having fine particles of graphite or carbon suspended therein and additionally, filler, such as silica. The semi-conductive overcoat may be applied to the core and overwrap by dipping the core in the polytetrafluoroethylene dispersion as described above, wiping the overcoat with a metal or rubber die and drying to sinter the overcoat, in situ, in a vertical heating tower. A suitable temperature for sintering polytetrafluoroethylene is about 750° F. The temperature during drying to sinter the overcoat is carefully regulated to control the resistance per unit length of strand, measured in ohms per foot.

The electrical conductor of this invention substantially eliminates interference to television and radio, for example, when utilized as a sparktype ignition cable, as described above. Further, the insulated conductor of this invention is particularly suitable for high temperature service applications, in excess of 450° F.

In another preferred process of producing the electrical conductor of this invention, a multiplicity of glass fibers are formed by attenuation and protected with a conventional starch sizing. The sized glass fibers are gathered into a strand and collected on a package and dried. Subsequently, the dried, sized glass fiber strands are saturated with a graphite-water dispersion or suspension to form a conductive core. The saturated glass fiber strands are dried on tandem — heated drums. These drums are heated to a temperature sufficient to control the resistance of the graphite coating, in situ, on the glass fiber strands. Thereafter, the dried conductive glass fiber strands are cooled. During the cooling of the conductive glass fibers, the resistance is monitored with equipment which controls the temperature of the drums since the resistance of the graphite coating is a function of the drying temperature. The conductive glass fiber strands are then overwrapped with non-conductive glass fibers and gathered onto a spool.

An aqueous overcoat composition, comprising a high temperature resistant polymer, such as polytetrafluoroethylene, conductive particles, such as graphite and amorphous filler, such as silica, as essential ingredients, is applied to the treated glass fiber strands above, such as by dipping. The overcoat composition partially impregnates the conductive core. The partially impregnated core is passed through stripper dies to control the amount of overcoat composition thereon, and is then dried in a vertical over to partially sinter the overcoat composition in situ. The thus treated core material is cooled and then treated with a second application of the overcoat composition and passed through larger stripper dies, and dried in a vertical oven to completely sinter the polytetrafluoroethylene. The double-overcoated core material is again monitored to check its resistance during drying since the semi-conductive overcoating and the conductive core interact as resistors-in-series, because they have different degrees of resistance. Thereafter, the overcoated, overwrapped, conductive glass fiber core material is gathered for subsequent processing such as extruding insulation thereon, to complete the making of a finished product, such as an ignition cable.

The amount of overcoat on the overwrapped conductive glass fiber core material ranges from about 5–40 percent by weight, and preferably ranges from about 20–30 percent by weight. The thickness of the overcoat is preferably about 0.002 to 0.005 inches thick.

Use is made of any starch-sized glass fibers with the concepts of this invention. When the starch-sized glass fibers are impregnated with the graphite-water dispersion and subjected to drying at temperature of about 650° F to about 1100° F, the starch decomposes to a gaseous state and dissipates from the dispersion, and the dispersion forms a coating on the glass fibers.

Polytetrafluoroethylene is the preferred high temperature resistant polymer, but other polymers that have high temperature resistance and/or chemical inertness are useable with the concepts of this invention. Polytetrafluoroethylene is commercially available as "Teflon 30" and "Fluon" and E. I. duPont de Nemours and Company and ICI Chemicals, respectively. Another polymer, a semi-conductive silicone rubber, is available commercially as "Silastic" from Dow-Corning Corporation. The preferred particle size range of the polytetrafluoroethylene is from about 0.1 to about 10 microns.

Graphite is the preferred conductive material but other conductive materials such as carbon may be used. It is preferred that the conductive material be dispersed in ammonium hydroxide or other volatile base. Graphite dispersions are commercially available as "Acheson EC 2577", "MS-99", and "EC-1982" from Acheson Colloid Company, and commercially available as "GW-222" from Dixon Graphite Company. Graphite has an elongated or plate-like structure which is capable of alignment. However, carbon black can be used even though it has high oil adsorbtion characteristics, but is less conductive since it is spherical and does not align as well. Carbon black is commerically available as "Vulcon XC-72-R" from Cabot Chemical Company. It is preferred to have the particle-size range of the graphite or carbon black, the same size as the particles of polytetrafluoroethylene. It also preferred to have the conductive particles in a touching relationship to insure conductance, but it has been documented that as long as the particles are spaced within 10 Angstroms, conductance is obtainable. Other conductive particles that may be used include red iron oxide, silver and pyrolytic polymers.

The preferred amorphous filler is silica since it has been found that silica affects the rheology of the conductive material by absorbing water present in the system and since silica is heat-stable to temperatures of about 1100° F. Furthermore, silica aids the conductive properties of the composition, adds stiffness or increases the modules of the dried coating, helps provide a smooth, uniform coating, and provides controlled adhesion between the overcoat on the conductive core and the insulating material. Amorphous fillers have a low crystalline structure and do not affect the physical properties of glass fibers, such as by abrasion. Amorphous silica is commercially available as "Neosil A" from Tammsco Company. Other amorphous fillers, possessing heat stability characteristics required by the processing temperatures of this invention are suitable, such as natural aluminum silicate, commercially available as "Kaolinite", from Freeport-Kaoline Company. The amorphous filler preferably has the same particle size range as the particles of polytetrafluoroethylene and graphite.

Additional ingredients to the overcoat composition may include a thixotrope, surfactant, anti-foam agents, pH adjustors and water to adjust solids. The thixotrope is added to help raise the initial viscosity of the overcoat composition, which after undergoing shear during mixing or at the stripper dies, returns to the initial viscosity. When a gel agent is applied instead of a thixotrope, the system does not revert back to the initial viscosity thereby leading to non-uniform coatings. The thixotrope may be organic or inorganic. One example of an organic thixotrope is commercially available as "Carbopol", from B.F. Goodrich Company. An inorganic thixotrope, such as fumed silica particles, is commercially available as "Cabosil" from Cabot Corporation. The thixotrope preferably has the same particle size as the graphite.

Surfactants useable with the concepts of this invention are preferably those that are used on the polytetrafluoroethylene particles, but can be any nonionic surfactant which aids in keeping the dispersion uniform. One surfactant is commercially available as "Triton-X100" from Rohm and Haas Company.

Anti-foams are added to the overcoat composition to prevent foaming during mixing and/or application of the overcoat composition to the conductive glass fibers. Foaming is undesirable since it leads to non-uniform coatings and instability in the dispersion mixture. Use is made of water-soluble, water emulsifiable and water-insoluble anti-foams. Water-soluble anti-foams are commercially available as 2-Ethyl Hexanol from Union Carbide Corporation and water-insoluble anti-foams are commercially available as "ANTIFOAM-A COMPOUND" from Dow-Corning Company. Water emulsifiable anit-foam are commercially available as "BD-110", "DB-31" and "H-10" from Dow Corning Company.

pH adjustors are optionally added to adjust the pH of the mixture to about 10 or above to prevent bacterial growth in the mixture upon storage and to help stabilize the rheology of the mixture specifically with respect to the thixotrope. Ammonium hydroxide is preferred, but any volatile base such as monoethanolamine or diethanolamine are suitable, or any mono or dialkanolamine may be used.

In the semi-conductive overcoat composition, the polytetrafluoroethylene, the conductive particles, and the amorphous filler have an average particle size distribution of from about 1 micron to about 2 microns.

In some instances it is possible and even desirable to produce an electrical conductor which does not require a non-conductive overwrap. Thereby, the improved electrical conductor of this invention comprises a conductive core and semi-conductive overcoat.

It has been found that by using the semi-conductive overcoat composition of this invention, the necessity of carefully controlling the uniformity of the cross-section of the conductive core via the use of spiral wraps of non-conductive strands, can be eliminated. This is due to the fact that the overcoat composition, upon heating, maintains a circular configuration to the overcoated, conductive core, developed by having passed the overcoated, conductive core through a circular die.

I claim:

1. An electrical conductor comprising:

a. an electrically conductive core comprising glass fibers;

b. a semi-conductive overcoat in contact with said core, said overcoat comprising polytetrafluoroethylene, conductive particles and an amorphous filler.

2. The conductor of claim 1 in which said amorphous filler is silica and said conductive particles are graphite or carbon black.

3. The conductor of claim 2 in which said conductive particles are graphite and in which about 10 percent of said graphite comprises particles having a size within the range of from 1 to 3 microns and about 90 percent of said graphite comprises particles having a size of less than one micron.

4. The conductor of claim 2 in which said overcoat comprises polytetrafluoroethylene in an amount within the range of from about 10 percent to about 60 percent by weight and graphite in an amount within the range of about 2 to about 55 percent by weight and said silica in an amount within the range of from about 1 to about 55 percent by weight.

5. The conductor of claim 2 in which said overcoat is sintered.

6. The conductor of claim 2 in which said overcoat has a thickness within the range of from about 0.002 to about 0.005 inches.

7. The conductor of claim 2 in which said polytetrafluoroethylene has a particle size within the range of from about 0.1 to about 10 microns.

8. The conductor of claim 2 in which said amorphous filler has a particle size within the range of from about 0.1 to about 10 microns.

9. The conductor of claim 4 in which said amorphous filler is silica having a particle size of from about 0.1 to about 10 microns, about 10 percent of said graphite comprising particles having a size of 1 to 3 microns and about 90 percent of said graphite comprising particles having a size of less than one micron and in which said overcoat comprises sintered polytetrafluoroethylene having particle size within the range of from about 0.1 to about 10 microns, said overcoat having a thickness of from about 0.002 to about 0.005 inches.

* * * * *